United States Patent [19]

Kleinecke et al.

[11] Patent Number: 4,739,672

[45] Date of Patent: Apr. 26, 1988

[54] MECHANICAL INTERLOCK FOR A VACUUM CONTACTOR

[75] Inventors: John D. Kleinecke; Thomas R. Little, both of Wichita Falls, Tex.

[73] Assignee: Siemens Energy & Automation, Inc., Atlanta, Ga.

[21] Appl. No.: 4,368

[22] Filed: Jan. 15, 1987

[51] Int. Cl.[4] ..... G05G 5/08

[52] U.S. Cl. ..... 74/483 R; 200/5 E

[58] Field of Search ..... 74/483 R, 483 PB, 878; 200/5 E, 5 EA

[56] References Cited

U.S. PATENT DOCUMENTS

| | | | |
|---|---|---|---|
| 1,407,458 | 2/1922 | Berry et al. | 74/483 R |
| 1,607,270 | 11/1926 | Smith | 200/5 E |
| 2,351,485 | 6/1984 | Conkle | 74/878 |
| 3,312,122 | 4/1967 | Conner et al. | 74/483 R |
| 3,622,719 | 11/1971 | Thomas | 74/483 R X |
| 3,842,689 | 10/1974 | Bagge | 74/483 R X |

*Primary Examiner*—Allan D. Herrmann
*Attorney, Agent, or Firm*—James G. Morrow

[57] ABSTRACT

A mechanical interlock is provided for a vacuum contactor assembly to insure that the second contactor cannot close after the first contactor closes. The interlock includes a support bracket, a cover plate and an interlock block which was first and second openings and is positioned between the support bracket and the cover plate. First and second ball bearings are positioned in the openings. The cover plate and interlock block are connected to the support bracket. First and second slide members each have an operating arm and a blocking arm with appropriate openings for cooperating with the ball bearings and interlock block openings. The operating arm of one slide is paired with the blocking arm of the other slide so when one operating arm moves the ball bearing it blocks the other slide from moving thereby preventing one of the vacuum contactors from operating.

9 Claims, 4 Drawing Sheets

FIG. 2
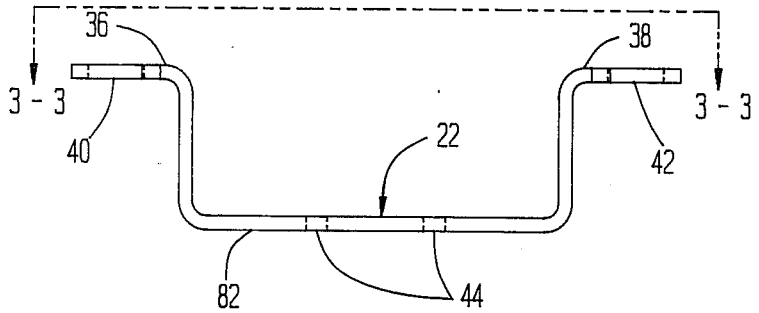
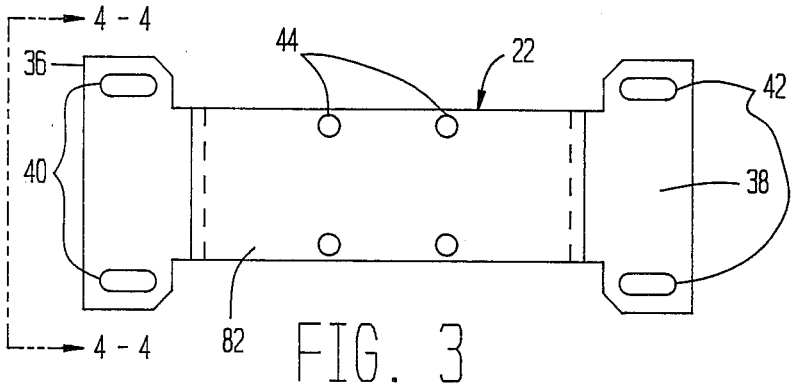
FIG. 3
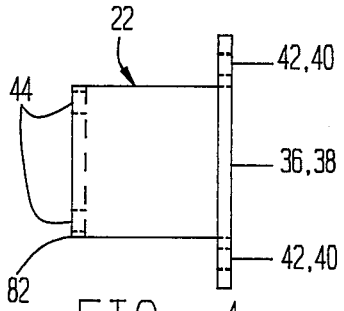
FIG. 4
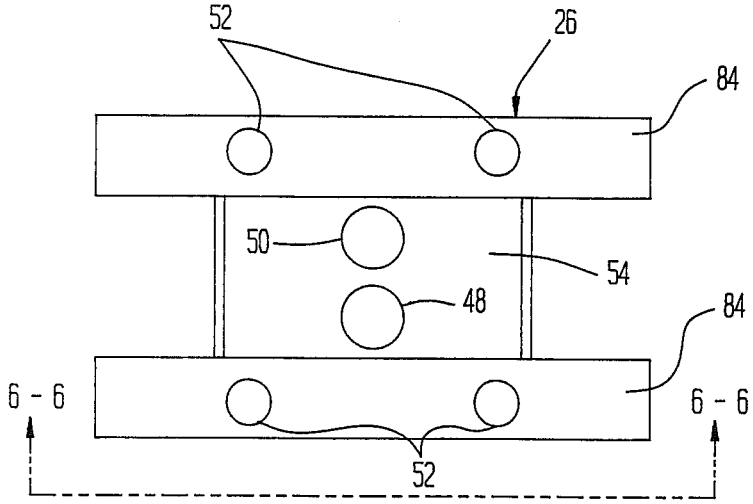
FIG. 5
FIG. 6
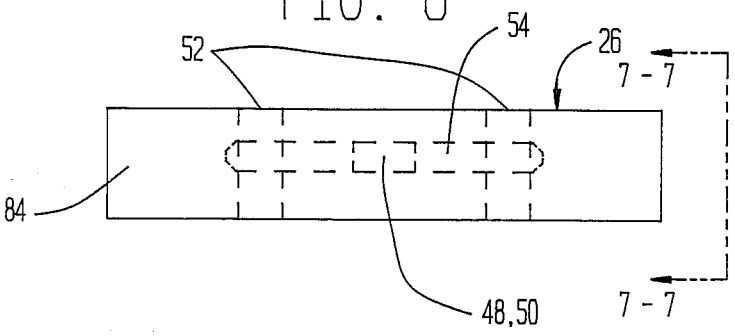
FIG. 7
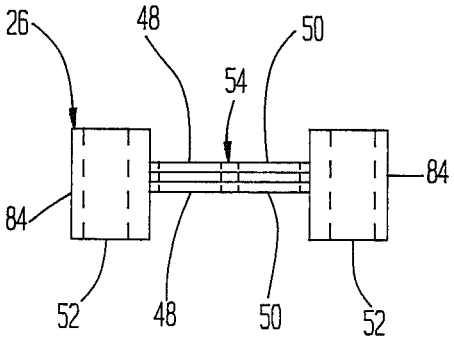

MECHANICAL INTERLOCK FOR A VACUUM CONTACTOR

BACKGROUND OF THE INVENTION

This invention relates to vacuum contactors and more particularly to a mechanical interlock for vacuum contactors which insures operation of only one of two contactors at a time.

Vacuum contactors are compact electrical devices which can open and close circuits quite effectively and efficiently. Since the electrical contacting parts are enclosed in a vacuum, there are no visible arcing parts which is desirable in many environments. In some applications, two vacuum contactors are employed with one closed to serve a particular function while the other one is open and vice versa. In these applications, it is not desirable to close both vaccum contactors simultaneously. It is possible to monitor the condition of a vacuum contactor to be informed of whether the contactor is open or closed; however, in some applications, it is not sufficient to merely know whether a contactor is open or closed. In some instances, one of the contactors must be prevented from opening or closing depending upon the condition of the other contactor. While operating conditions can be monitored, it is simply insufficient to known the operating condition of one vacuum contactor when one must be controllable in response to the operating condition of the other.

One of the problems with vacuum contactors is that their moving components are sealed inside the vacuum bottle. However, there is a small amount of detectable movement when the vacuum bottles are mounted in an environment such as in a motor controller. Even though it is known that a small amount of movement exists, there is no practical way to utilize this movement to achieve the result which is desired of preventing operation of one vacuum contact depending upon the condition of the other vacuum contactor. Accordingly, it will be appreciated that it would be highly desirable to have a device which would prevent operation of the second vacuum contactor when the first vacuum contactor is closed and to prevent closing of the first vacuum contactor when the second contactor is already closed.

Accordingly, it is an object of the present invention to provide a mechanical interlock device which blocks closing of one vacuum contactor as soon as the other vacuum contactor closes.

Another object of the present invention is to provide a mechanical interlock which achieves the interlock function by using the small limited movement of the vacuum contactor. Another object of the present invention is to provide a mechanical interlock which is simple to manufacture and use.

SUMMARY OF THE INVENTION

Briefly stated, in accordance with one aspect of the invention, a mechanical interlock is provided for a vacuum contactor. The interlock includes a support bracket, a cover plate and an interlock block which has first and second openings and is positioned between the support bracket and the cover plate. First and second balls are respectively positioned in the first and second interlock block openings. The cover plate and interlock block are connected to the support bracket. A first slide member has an operating arm with an opening therein receiving the first ball bearing and has a blocking arm with an opening therein. The first slide is slidably movable between a first position at which the operating arm opening and the first interlock block opening are aligned and a second position at which the operating arm opening and first interlock block opening are not aligned. The interlock also includes a second slide which has an operating arm with an opening therein receiving the second ball and a blocking arm with an opening therein. The second slide is slidably movable between a first position at which the operating arm opening and the second interlock block opening are aligned and a second position at which the operating arm opening and second interlock block operating are not aligned.

BRIEF DESCRIPTION OF THE DRAWINGS

While the specification concludes with claims particularly pointing out and distinctly claiming the subject matter which is regarded as the invention, it is belived that the invention would be better understood from the following description of the preferred embodiment taken in conjunction with the accompanying drawings in which:

FIG. 2 is a side view of a support bracket for the mechanical interlock;

FIG. 3 is a top view of the support bracket taken along plane 3—3;

FIG. 4 is an end view of the support bracket of FIG. 3 taken along plane 4—4;

FIG. 5 is a top view of the interlock block;

FIG. 6 is a side view of the interlock block of FIG. 5 taken along plane 6—6;

FIG. 7 is an end view of the interlock block illustrated in FIGS. 5 and 6 taken along plane 7—7;

DESCRIPTION OF THE PREFERRED EMBODIMENT

Figure 1:
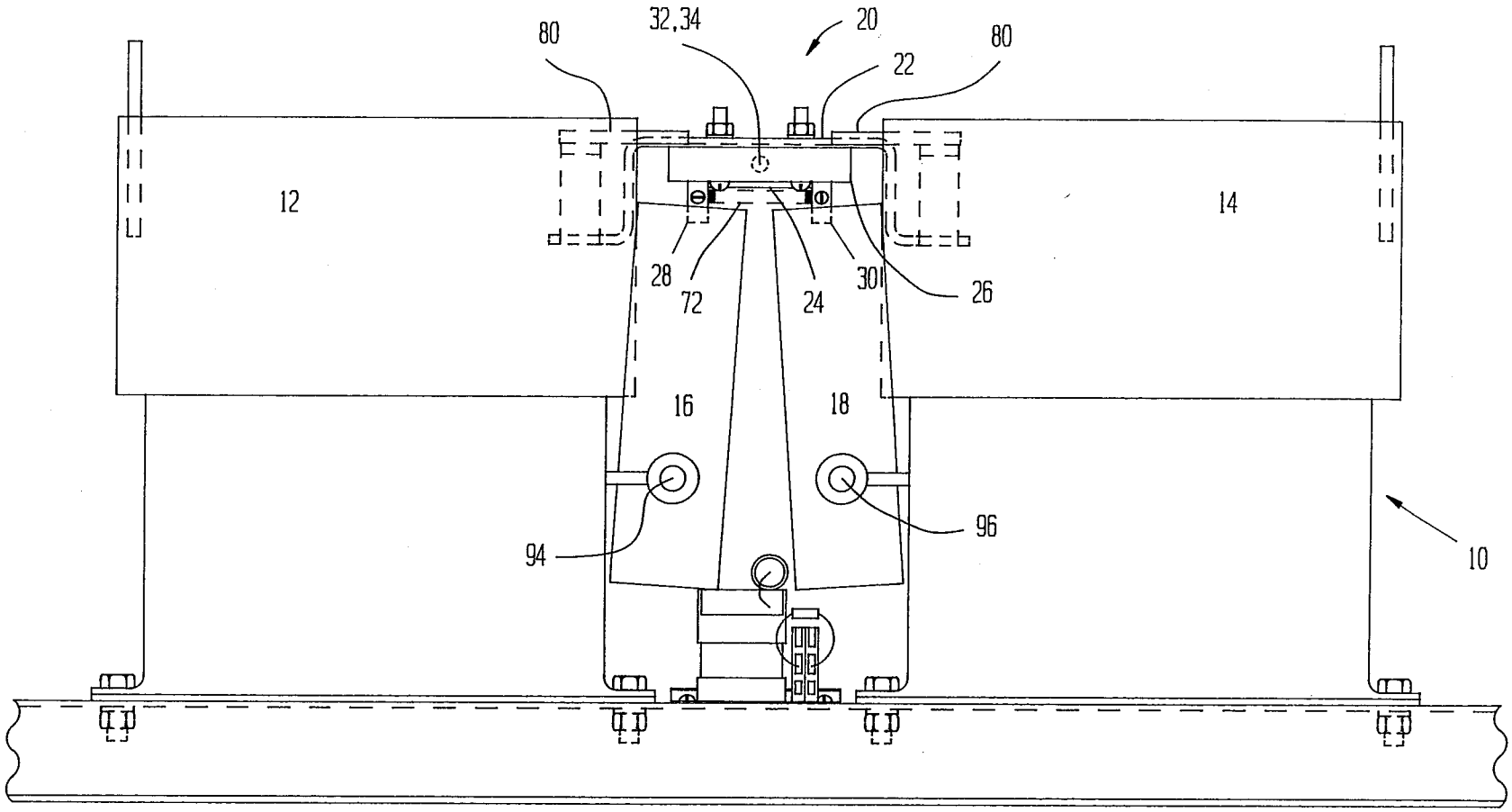
FIG. 1 is a diagrammatic illustration of a mechanical interlock in accordance with the present invention, used in conjunction with vacuum contactors.
Figure 11:
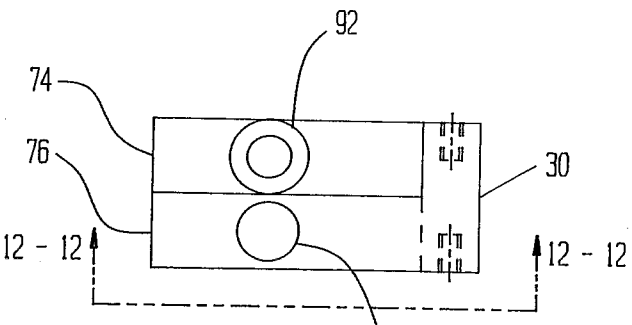
FIG. 11 is a top view of another slide member.
Figure 12:
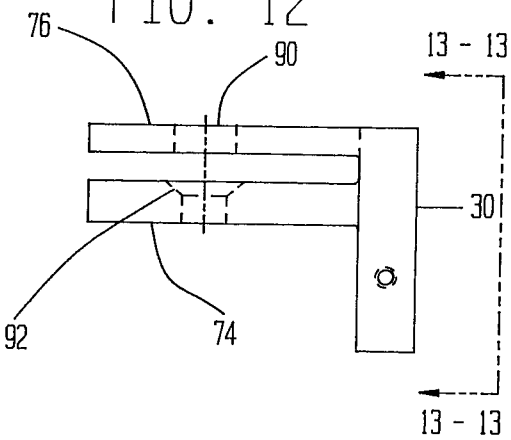
FIG. 12 is a side view of the slide member of FIG. 11 taken along plane 12—12.
Figure 13:
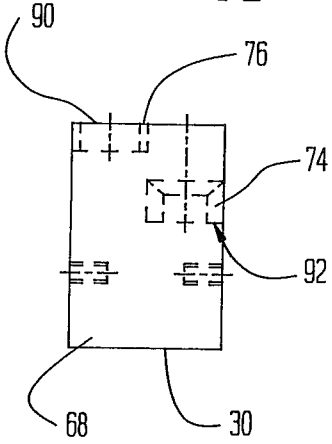
FIG. 13 is an end view of the slide member of FIGS. 11 and 12 taken along plane 13—13.
Figure 10:
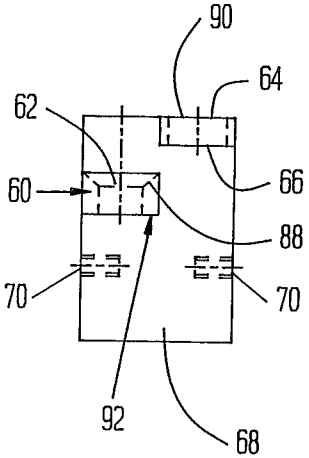
FIG. 10 is an end view of the slide member of FIGS. 8 and 9 taken along plane 10–10.
Figure 8:
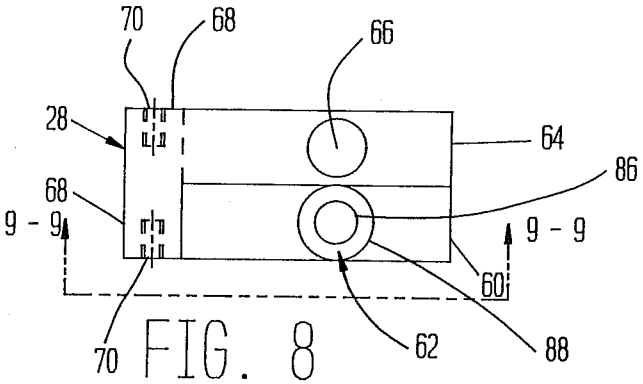
FIG. 8 is a top view of a slide member.
Figure 9:
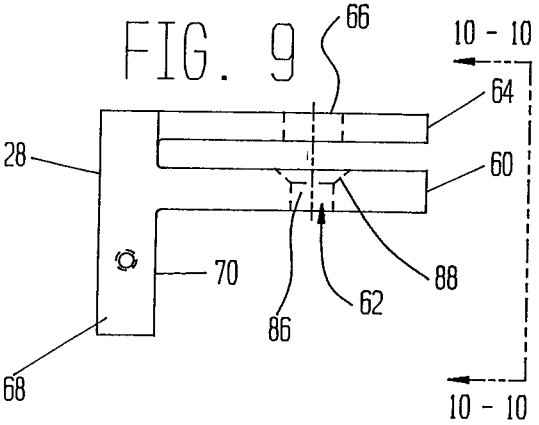
FIG. 9 is a side view of the slide member of FIG. 8 taken along plane 9—9.

Referring to FIG. 1, electrical apparatus such as a vacuum contactor 10, includes first and second vacuum contactor assemblies 12, 14, each of which includes a moving member 16, 18 which moves in response to the opening and closing of the vacuum contactor. As illustrated in FIG. 1, the moving members 16, 18 have a rotating movement about the pivots 94, 96 which translates to a lateral movement at the end of each of the moving members 16, 18 at their connection point to the mechanical interlock 20. The mechanical interlock 20 includes a support bracket 22, a cover plate 24, an interlock block 26 and first and second slides 28, 30. The mechanical interlock also includes first and second ball bearings (balls such as those found in a ball bearing) 32, 34.

Referring to FIGS. 2–4, the mounting bracket 22 has a general U configuration with the end portions of the legs of the U bent relative to the legs at approximately 90° angles outside away from the center of the U. This forms end flanges 36, 38 which may be provided with holes or openings 40, 42 which may be used to secure the mounting bracket 22 to the framework 80 of the vacuum contactor 10. The mounting bracket 22 also contains a number of openings 44 in its central portion which is the bottom 82 of the U. The mounting bracket 22 is preferably constructed of metal such as steel or copper alloy but may be constructed of any suitable strong, durable material.

Referring to FIGS. 5–7, the interlock block 26 has first and second openings 48, 50 and a number of other openings 52 which are alignable with the openings 44 of the mounting bracket 22. These openings 44 are of a size and construction sufficient for receiving fastening devices such as bolts or screws. The interlock block 26 has an H-shaped configuration with two upright members 84 and a cross member 54 which contains the first and second interlock block openings 48, 50. The unright members contain the openings 52 which are used for connecting the interlock block 26 to the mounting bracket 22 and cover plate 24. The first interlock block opening 48 has a diameter which is larger than the diameter of the first ball 32 so that the ball 32 is free to move vertically through the opening 48. Similarly, the interlock block second opening 50 has a diameter larger than the second ball 34 so that the second ball 34 may move vertically. By moving vertically it is meant that the balls move in a direction parallel to the upright members 84 of the cross member 54 and in a direction perpendicular to the cross member 54. The interlock block openings 48, 50 are preferably aligned side-by-side between the upright members 84 in the H configuration as will be more fully appreciated as explained below.

Referring to FIGS. 8–13, the first slide 28 has an operating arm 60 with an opening 62 therein and has a blocking arm 64 with an opening 66 therein. The first slide also has a vertical member 68. The first slide 28 also has one or more openings 70 for receiving screws for anchoring one or more springs 72 for biasing the slides 28, 30 toward one another. As illustrated, the operating arm 60 is at a lower elevation than the blocking arm 64 and it located on the opposite portion of the vertical member 68. The operating arm 60 and the blocking arm 64 are vertically separated a distance slightly greater than the thickness of the cross member 54 of the interlock block 26. By this construction, the first interlock is able to engage the interlock block 26 so that the blocking arm 64 is above the cross member 54 and the operating arm 60 is below the cross member 54. This construction allows the first slide 28 operating arm 60 opening 62 to receive the first ball 32 through the first opening 48 of the interlock block 26. The opening 62 is preferably a two-part opening with a first portion 86 located at a lower elevation having a first small diameter and a second portion 88 located at a higher elevation having a diameter larger than the lower elevation portion of the opening 62. The larger portion of the opening 62 has a diameter larger than the diameter of the first ball 32 so that the slide 28 is able to slide when the ball bearing 32 resting in the opening 62 which occurs when the opening 60 and the opening 48 are aligned. As shown, the sides of the larger opening 62 slope inwardly towards the smaller opening forming a ramp. The first slide 28 is slidably movable relative to the interlock block 26 between a first position at which the operating arm opening 62 and the first interlock block opening 48 are aligned and a second position at which the operating arm opening 62 and first interlock block opening 48 are not aligned. On the other hand, when the second ball 34 engages the opening 66 of the blocking arm 64, there is insufficient tolerance to facilitate relative movement then between the first slide 28 and the interlock block 26. Thus, the slide 28 is prevented from moving or sliding relative to the interlock block 26 when the second ball 34 is in a position such that it fully engages the opening 66 of the blocking arm 64.

The second interlock slide 30 is similarly constructed, except that the horizontal or lateral position of the operating arm 74 and blocking arm 76 are located such that the operating arm 74 aligns in the space adjacent to the operating arm 60 of the first slide 28 and below the blocking arm 64 while the blocking arm 76 aligns in the space beside the blocking arm 64 of the first slide 28 and above the operating arm 60. In this manner, the first slide 28 and second slide 30 intermesh. It is apparent that the first slide operating arm 60 and the second slide blocking arm 76 work in conjunction with the first ball while the first slide blocking arm 64 and the second slide operating arm 72 work in conjunction with the second ball 34. The second slide 30 is slidably movable between a first position at which the operating arm opening 74 and the second interlock block opening 50 are aligned and a second position at which the operating arm opening 74 and second interlock block opening 50 are not aligned.

Figure 14:
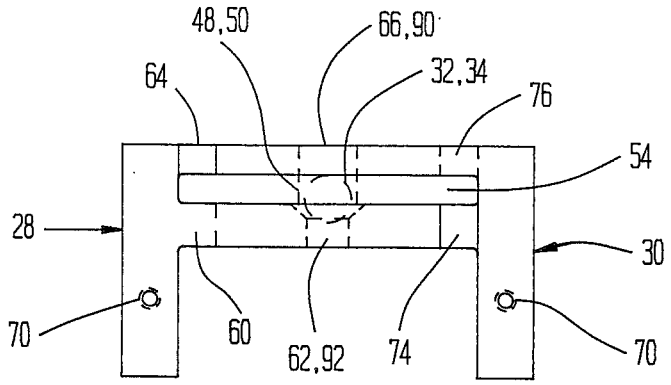
FIG. 14 is a side view of the mechanical interlock.
Figure 15:
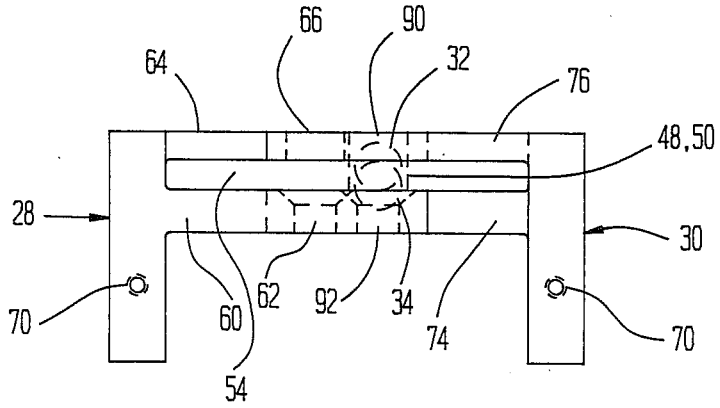
FIG. 15 is a side view of the mechanical interlock, wherein one slide member is locked.

Operation of the mechanical interlock is straightforward as illustrated in FIGS. 14 and 15. After assembly, the first and second balls 32, 34 are essentially located in the first and second interlock block openings 66, 90 and drop down into or merely extend into the respective openings 62, 92 of the operating arms 60, 74. When properly assembled and aligned in the vacuum contactor 10, this will correspond to an open condition of each vacuum contactor 12, 14. If the first vacuum contactor 12 is closed, such closure will cause the moving member 16 to move which will act on the first slide 28 causing the slide 28 to move from the first position to the second position. At the first position, the openings 62, 66, 90, 92, 48, 50 are all aligned and the balls 32, 34 are at their lowest point. In the second position in the openings 60, 62, 48, 50 are not aligned which means that the ball 32 is forced upward by the inclined side of the operating arm opening 60. The upward movement of the ball 32 causes it to protrude above the cross member 54 of the interlock block where it engages the opening 90 of the blocking member 76 of the second slide 30. This prevents the second slide from moving and therefore prevents the second contactor 14 from closing. If the second contactor closes first, the converse is true. When the second contactor closes first, the first contactor is then prevented from closing by the upward movement of the second ball bearing 34 into engagement with the opening of the first slide blocking arm 64 opening 66.

It can now be appreciated that there has been presented a mechanical interlock for a vacuum contactor which prevents the second vacuum contactor from closing once the first contactor has closed and it also prevents the first contactor from closing if the second contactor has been closed. The mechanical interlock is simple to assemble and install and provides positive mechanical interlocking action which prevents both vacuum contactors from being closed simultaneously.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirt and script of the invention.

What is claimed as new and desired to be secured by Letters Patent of the United States is:

1. A mechanical interlock, comprising:

a support bracket;

a cover plate;

an interlock block having first and second openings and being positioned between the support bracket and the cover plate;

a first ball positioned in the first interlock block opening;

a second ball positioned in the second interlock block opening;

means for connecting the cover plate and interlock block to the support bracket;

a first slide having an operating arm with an opening therein for receiving the first ball and having a blocking arm with an opening therein, the first slide being slidably movable between a first position at which the operating arm opening and the first interlock block opening are aligned and a second position at which the operating arm opening and first interlock block opening are not aligned; and a second slide having an operating arm with an opening therein for receiving the second ball and having a blocking arm with an opening therein, the second slide being slidably movable between a first position at which the operating arm opening and the second interlock block opening are aligned and a second position at which the operating arm opening and second interlock block opening are not aligned.

2. A mechanical interlock according to claim 1, wherein the first ball moves into the second slide blocking arm opening thereby preventing movement of the second slide in response to moving the first slide from the first position towards the second position.

3. A mechanical interlock according to claim 1, wherein the second ball moves into the first slide blocking arm opening thereby preventing movement of the first slide in response to moving the second slide from the first position towards the second position.

4. A mechanical interlock according to claim 1, wherein the interlock block has an H-shaped cross-sectional configuration formed by two upright members joined by a cross member, said cross member containing the first and second openings.

5. A mechanical interlock according to claim 4, wherein each of the upright members of the H-shaped cross section of the interlock block have at least one opening therein to receive a fastening device to fasten the interlock block to the support bracket.

6. A mechanical interlock according to claim 4, wherein the first slide operating arm and the second slide operating arm are each positioned above the connecting member of the H-shaped interlock block and the first slide blocking arm and second slide blocking arm each are positioned below the cross member with the first slide operating arm and the second slide blocking arm being vertically aligned and the first slide blocking arm and the second slide operating arm being vertically aligned.

7. A mechanical interlock according to claim 4, wherein the first slide blocking arm opening has a diameter smaller than the diameter of the first ball so that the first ball bearing enters into the first slide blocking arm opening only a preselected distance while the majority of the first ball remains in the interlock block first opening which is located in the cross member thereby blocking movement of the first slide relative to the crossbar member.

8. A mechanical interlock according to claim 4, wherein the first slide operating arm opening has a diameter larger than the diameter of the first ball so that the first slide can move relative to the crossbar member when the ball extends into the first slide operating arm opening.

9. A mechanical interlock according to claim 4, wherein the first slide includes a vertical member connected to the operating arm and the blocking arm and wherein the second slide has a vertical member connected to its operating arm and blocking arm and including a spring connected to the first slide vertical member and to the second slide vertical member biasing the first and second slides toward one another.

* * * * *